US012358036B2

(12) United States Patent
Toda et al.

(10) Patent No.: US 12,358,036 B2
(45) Date of Patent: Jul. 15, 2025

(54) HOT-STAMPING FORMED BODY

(71) Applicant: NIPPON STEEL CORPORATION, Tokyo (JP)

(72) Inventors: Yuri Toda, Tokyo (JP); Kodai Murasawa, Tokyo (JP); Daisuke Maeda, Tokyo (JP); Kazuo Hikida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/781,325

(22) PCT Filed: Jan. 8, 2021

(86) PCT No.: PCT/JP2021/000424
§ 371 (c)(1),
(2) Date: May 31, 2022

(87) PCT Pub. No.: WO2021/141100
PCT Pub. Date: Jul. 15, 2021

(65) Prior Publication Data

US 2023/0001466 A1 Jan. 5, 2023

(30) Foreign Application Priority Data

Jan. 9, 2020 (JP) ..... 2020-002408

(51) Int. Cl.

| | |
|---|---|
| ***B21D 22/02*** | (2006.01) |
| ***C21D 1/18*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |

(Continued)

(52) U.S. Cl.

CPC ..... *B21D 22/022* (2013.01); *C21D 1/18* (2013.01); *C21D 6/005* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/10* (2013.01); *C22C 38/105* (2013.01); *C22C 38/12* (2013.01); *C22C 38/14* (2013.01); *C22C 38/16* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/34* (2013.01); *C22C 38/38* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C22C 38/60* (2013.01); *C21D 1/19* (2013.01); *C21D 1/22* (2013.01); *C21D 1/673* (2013.01); *C21D 6/008* (2013.01); *C21D 7/13* (2013.01); *C21D 2201/05* (2013.01); *C21D 2211/001* (2013.01); *C21D 2211/002* (2013.01); *C21D 2211/008* (2013.01)

(58) Field of Classification Search

CPC ..... B21D 22/022; C21D 1/18; C21D 1/19; C21D 1/22; C21D 1/673; C21D 6/005; C21D 6/008; C21D 7/13; C21D 2201/05; C21D 2211/001; C21D 2211/002; C21D 2211/008; C22C 38/001; C22C 38/002; C22C 38/005; C22C 38/02; C22C 38/04; C22C 38/06; C22C 38/08; C22C 38/10; C22C 38/105; C22C 38/12; C22C 38/14; C22C 38/16; C22C 38/18; C22C 38/20; C22C 38/22; C22C 38/24; C22C 38/26; C22C 38/28; C22C 38/30; C22C 38/32; C22C 38/34; C22C 38/38; C22C 38/40; C22C 38/42; C22C 38/44; C22C 38/46; C22C 38/48; C22C 38/50; C22C 38/52; C22C 38/54; C22C 38/58; C22C 38/60

See application file for complete search history.

(56) References Cited

U.S. PATENT DOCUMENTS

| | | | |
|---|---|---|---|
| 2014/0056753 | A1 | 2/2014 | Naitou et al. |
| 2016/0145704 | A1 | 5/2016 | Kawasaki et al. |

(Continued)

FOREIGN PATENT DOCUMENTS

| | | | |
|---|---|---|---|
| JP | 2017-53001 | A | 3/2017 |
| KR | 10-2019-0001482 | A | 1/2019 |

(Continued)

*Primary Examiner* — Michael E. La Villa
(74) *Attorney, Agent, or Firm* — Birch, Stewart, Kolasch & Birch, LLP

(57) ABSTRACT

A hot-stamping formed body has a predetermined chemical composition and includes microstructure which includes residual austenite of which an area ratio is 10% or more and less than 20%. Among grain boundaries of crystal grains of bainite and tempered martensite, a ratio of a length of a grain boundary having a rotation angle in a range of 55° to 75° to a total length of a grain boundary having a rotation angle in a range of 4° to 12°, a grain boundary having a rotation angle in a range of 49° to 54°, and the grain boundary having a rotation angle in a range of 55° to 75° to the <011> direction as a rotation axis is 30% or more.

3 Claims, No Drawings

(51) Int. Cl.

| | |
|---|---|
| ***C22C 38/14*** | (2006.01) |
| ***C22C 38/16*** | (2006.01) |
| ***C22C 38/18*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/34*** | (2006.01) |
| ***C22C 38/38*** | (2006.01) |
| ***C22C 38/40*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C22C 38/60*** | (2006.01) |
| *C21D 1/19* | (2006.01) |
| *C21D 1/22* | (2006.01) |
| *C21D 1/673* | (2006.01) |
| *C21D 7/13* | (2006.01) |

(56) References Cited

U.S. PATENT DOCUMENTS

| | | | | |
|---|---|---|---|---|
| 2018/0298462 | A1 | 10/2018 | Sano et al. | |
| 2020/0157666 | A1 | 5/2020 | Sakakibara et al. | |
| 2020/0100621 | A1 | 6/2020 | Cobo et al. | |
| 2021/0292888 | A1 | 9/2021 | Yoo et al. | |
| 2022/0119911 | A1 | 4/2022 | Yi et al. | |
| 2023/0002874 | A1* | 1/2023 | Toda | C22C 38/08 |
| 2023/0040050 | A1* | 2/2023 | Toda | C22C 38/105 |

FOREIGN PATENT DOCUMENTS

| | | | |
|---|---|---|---|
| WO | WO 2015/041159 | A1 | 3/2015 |
| WO | WO 2016/199922 | A1 | 12/2016 |
| WO | WO 2018/033960 | A1 | 2/2018 |
| WO | WO 2018/220549 | A1 | 12/2018 |
| WO | WO 2018/205888 | A1 | 10/2019 |

* cited by examiner

HOT-STAMPING FORMED BODY

TECHNICAL FIELD

The present invention relates to a hot-stamping formed body.

Priority is claimed on Japanese Patent Application No. 2020-002408, filed Jan. 9, 2020, the content of which is incorporated herein by reference.

BACKGROUND ART

In recent years, there has been a demand for a reduction in the weight of the vehicle body of a vehicle in terms of environmental protection and resource saving, and a high strength steel sheet has been applied to vehicle members. Vehicle members are manufactured by press forming, but not only a forming load is increased but also the formability deteriorates as the strength of a steel sheet is increased. For this reason, the formability of the high strength steel sheet into a member having a complicated shape becomes an issue. In order to solve this issue, the application of hot stamping technology in which press forming is performed after a steel sheet is heated up to a high temperature of an austenite range where the steel sheet softens is in progress. Hot stamping is attracting attention as technology that achieves both the formability of a steel sheet into a vehicle member and the strength of the vehicle member by performing the hardening of the steel sheet in a die at the same time as press working.

In order to obtain a higher effect of reducing the weight of a vehicle body from a vehicle member into which a steel sheet is formed by hot stamping, it is necessary to obtain a member that has high strength and is also excellent in collision characteristics.

Patent Document 1 discloses a hot-dip galvanized steel sheet and a hot-dip galvannealed steel sheet that are stabilized by the concentration of C and Mn and are improved in strength, uniform deformability, and local deformability by containing 10% by volume or more of residual austenite, and methods of manufacturing the hot-dip galvanized steel sheet and the hot-dip galvannealed steel sheet.

Patent Document 2 discloses a hot-dip galvannealed steel sheet that is improved in strength, uniform deformability, and local deformability by including residual austenite of 10% by volume or more and including high-temperature tempered martensite and low-temperature tempered martensite at predetermined volume percentages.

Patent Document 3 discloses a high-strength hot press-formed member that is improved in ductility and bendability by including composite structure as the structure of steel and controlling a ratio of each structure of the composite structure.

A vehicle member that has excellent strength and is more excellent in collision characteristics than the related art is desired in terms of safety.

CITATION LIST

Patent Document

Patent Document 1: Japanese Unexamined Patent Application, First Publication No. 2017-53001

Patent Document 2: PCT International Publication No. WO2016/199922

Patent Document 3: PCT International Publication No. WO2018/033960

SUMMARY OF INVENTION

Technical Problem

An object of the present invention is to provide a hot-stamping formed body that is excellent in strength and collision characteristics.

Solution to Problem

The gist of the present invention is as follows.

[1] A hot-stamping formed body according to an aspect of the present invention includes, as a chemical composition, by mass %:

C: 0.15% to 1.00%;
Si: 0.50% to 3.00%;
Mn: more than 3.00% and 5.00% or less;
Al: 0.100% to 3.000%;
Co: 0.100% to 3.000%;
P: 0.100% or less;
S: 0.1000% or less;
N: 0.0100% or less;
Nb: 0% to 0.15%;
Ti: 0% to 0.150%;
Mo: 0% to 1.00%;
Cr: 0% to 1.00%;
Cu: 0% to 1.00%;
V: 0% to 1.00%;
W: 0% to 1.00%;
Ni: 0% to 3.00%;
Mg: 0% to 1.00%;
Zr: 0% to 1.00%;
Sb: 0% to 1.00%;
Ca: 0% to 0.10%;
REM: 0% to 0.30%;
B: 0% to 0.0100%; and a remainder comprising Fe and impurities; and a microstructure which includes residual austenite of which an area ratio is 10% or more and less than 20%, fresh martensite of which an area is 5% to 15%, bainite and tempered martensite of which a total area ratio is 65% to 85%, and a remainder in microstructure of which an area ratio is less than 5%, and among grain boundaries of crystal grains of the bainite and the tempered martensite, a ratio of a length of a grain boundary having a rotation angle in a range of 55° to 75° to a total length a grain boundary having a rotation angle in a range of 4° to 12°, a grain boundary having a rotation angle in a range of 49° to 54°, and the grain boundary having a rotation angle in a range of 55° to 75° to the <011> direction as a rotation axis is 30% or more.

[2] The hot-stamping formed body according to [1] may include, as the chemical composition, by mass %, one or two or more selected from the group consisting of:

Nb: 0.01% to 0.15%;
Ti: 0.010% to 0.150%;
Mo: 0.005% to 1.00%;
Cr: 0.005% to 1.00%;
Cu: 0.001% to 1.00%;
V: 0.0005% to 1.00%;
W: 0.001% to 1.00%;
Ni: 0.001% to 3.00%;
Mg: 0.001% to 1.00%;
Zr: 0.001% to 1.00%;
Sb: 0.001% to 1.00%;
Ca: 0.001% to 0.10%;
REM: 0.001% to 0.30%; and
B: 0.0005% to 0.0100%.

Advantageous Effects of Invention

According to the aspect of the present invention, it is possible to obtain a hot-stamping formed body that is excellent in strength and collision characteristics.

EMBODIMENTS OF THE INVENTION

The inventors have found that a hot-stamping formed body can be improved in collision characteristics while ensuring high strength in a case where the microstructure of the hot-stamping formed body includes predetermined amounts of residual austenite, fresh martensite, and bainite and tempered martensite, and among grain boundaries of crystal grains of the bainite and the tempered martensite, a ratio of a length of a grain boundary (high angle boundary) having a rotation angle in a range of 55° to 75° to a total length of a grain boundary having a rotation angle in a range of 4° to 12°, a grain boundary having a rotation angle in a range of 49° to 54°, and the grain boundary (hereinafter, may be referred to as a high angle boundary) having a rotation angle in a range of 55° to 75° to the <011> direction as a rotation axis is set to 30% or more. In this embodiment, excellent collision characteristics mean excellent strain dispersion characteristics and bendability.

The high angle boundary is a grain boundary that has the highest angle among grain boundaries included in the crystal grains of bainite and tempered martensite. When austenite is transformed into bainite or martensite, strain associated with the transformation is generated. In a case where austenite before the transformation has high hardness or a case where prior austenite grains cannot be easily deformed, a high angle boundary, which is highly effective in relieving strain, is likely to be formed. The inventors have found that by holding the steel in a low temperature range after hot stamping, prior austenite grains are made to have high hardness, and then the prior austenite can be transformed into bainite or martensite, and many high angle boundaries can be formed.

A hot-stamping formed body according to this embodiment will be described in detail below. First, the reason why the chemical composition of the hot-stamping formed body according to this embodiment is to be limited will be described.

A limited numerical range described using "to" to be described below includes a lower limit and an upper limit. Numerical values represented using "less than" or "more than" are not included in a numerical range. All percentages (%) related to the chemical composition mean mass %.

The hot-stamping formed body according to this embodiment includes, as a chemical composition, by mass %, C: 0.15% to 1.00%, Si: 0.50% to 3.00%, Mn: more than 3.00% and 5.00% or less, Al: 0.100% to 3.000%, Co: 0.100% to 3.000%, P: 0.100% or less, S: 0.1000% or less, N: 0.0100% or less, and a remainder: Fe and impurities. Each element will be described in detail below.

"C: 0.15% to 1.00%"

C is an element that improves the strength of the hot-stamping formed body. Further, C is also an element that stabilizes residual austenite. In a case where the C content is less than 0.15%, the desired strength of the hot-stamping formed body cannot be obtained. For this reason, the C content is set to 0.15% or more. The C content is preferably 0.30% or more, more preferably 0.45% or more. Meanwhile, in a case where the C content is more than 1.00%, steel is embrittled. For this reason, the C content is set to 1.00% or less. It is preferable that the C content is 0.80% or less or 0.70% or less.

"Si: 0.50% to 3.00%"

Si is an element that stabilizes the residual austenite. In a case where the Si content is less than 0.50%, the above-mentioned effects are not obtained and the stabilization of the residual austenite is insufficient. As a result, a desired amount of the residual austenite cannot be obtained. For this reason, the Si content is set to 0.50% or more. The Si content is preferably 1.00% or more or 1.40% or more. Meanwhile, in a case where the Si content is more than 3.00%, the amount of ferrite is increased. As a result, a desired microstructure is not obtained. For this reason, the Si content is set to 3.00% or less. The Si content is preferably 2.50% or less or 2.00% or less.

"Mn: More than 3.00% and 5.00% or Less"

Mn is an element that facilitates bainitic transformation in a low temperature range by lowering an Ms point. In a case where the Mn content is 3.00% or less, a desired number of high angle boundaries cannot be obtained. For this reason, the Mn content is set to be more than 3.00%. The Mn content is preferably 3.20% or more or 3.30% or more. Meanwhile, in a case where the Mn content is more than 5.00%, early fracture is likely to occur. For this reason, the Mn content is set to 5.00% or less. The Mn content is preferably 4.50% or less or 4.00% or less.

"Al: 0.100% to 3.000%"

Al is an element that improves deformability by deoxidizing molten steel to suppress the formation of oxide serving as the origin of fracture and improves the collision characteristics of the hot-stamping formed body. In a case where the Al content is less than 0.100%, deoxidation is not sufficiently performed and coarse oxide is generated. As a result, the above-mentioned effects are not obtained. For this reason, the Al content is set to 0.100% or more. The Al content is preferably 0.120% or more, 0.200% or more, or 0.300% or more. Meanwhile, in a case where the Al content is more than 3.000%, coarse oxide is generated in steel. As a result, the collision characteristics of the hot-stamping formed body deteriorate. For this reason, the Al content is set to 3.000% or less. The Al content is preferably 2.500% or less, 2.000% or less, 1.500% or less, or 1.000% or less.

"Co: 0.100% to 3.000%"

Co is an element that facilitates bainitic transformation in a low temperature range by lowering an Ms point. In a case where the Co content is less than 0.100%, a desired amount of bainite cannot be obtained. For this reason, the Co content is set to 0.100% or more. It is preferable that the Co content is 0.110% or more or 0.120% or more. Meanwhile, in a case where the Co content is more than 3.000%, early fracture is likely to occur. For this reason, the Co content is set to 3.000% or less. It is preferable that the Co content is 2.000% or less or 1.6000% or less.

"P: 0.100% or Less"

P is an impurity element and serves as the origin of fracture by being segregated at a grain boundary. For this reason, the P content is set to 0.100% or less. The P content is preferably 0.050% or less or 0.030% or less. The lower limit of the P content is not particularly limited. However, in a case where the lower limit of the P content is reduced to less than 0.0001%, cost required to remove P is significantly increased, which is not preferable economically. For this reason, 0.0001% may be set as the lower limit of the P content in actual operation.

"S: 0.1000% or Less"

S is an impurity element and forms an inclusion in steel. Since this inclusion serves as the origin of fracture, the S content is set to 0.1000% or less. The S content is preferably 0.0500% or less, 0.0200% or less, or 0.0100% or less. The lower limit of the S content is not particularly limited. However, in a case where the lower limit of the S content is reduced to less than 0.0001%, cost required to remove S is significantly increased, which is not preferable economically. For this reason, 0.0001% may be set as the lower limit of the S content in actual operation.

"N: 0.0100% or Less"

Nis an impurity element and forms nitride in steel. Since this nitride serves as the origin of fracture, the N content is set to 0.0100% or less. The N content is preferably 0.0050% or less or 0.0040% or less. The lower limit of the N content is not particularly limited. However, in a case where the lower limit of the N content is reduced to be less than 0.0001%, cost required to remove N is significantly increased, which is not preferable economically. For this reason, 0.0001% may be set as the lower limit of the N content in actual operation.

The remainder of the chemical composition of the hot-stamping formed body according to this embodiment may be Fe and impurities. Elements, which are unavoidably mixed from a steel raw material or scrap and/or during the manufacture of steel and are allowed in a range where the characteristics of the hot-stamping formed body according to this embodiment do not deteriorate, are exemplary examples of the impurities.

The hot-stamping formed body according to this embodiment may contain the following elements as arbitrary elements instead of a part of Fe. The contents of the following arbitrary elements, which are obtained in a case where the following arbitrary elements are not contained, are 0%.

"Nb: 0% to 0.15%"

"Ti: 0% to 0.150%"

Nb and Ti increase the ratio of a high angle boundary by refining prior austenite grains in heating before hot stamping and suppressing the deformation of prior austenite grains in a case where austenite is transformed into bainite or martensite. In order to reliably exert this effect, it is preferable to contain any one or more of Nb: 0.01% or more and Ti: 0.010% or more. Meanwhile, even when the Nb content is more than 0.15% or the Ti content is more than 0.150%, the above effect is saturated, and thus, it is preferable that the Nb content is 0.15% or less and the Ti content is 0.150% or less.

"Mo: 0% to 1.00%"

"Cr: 0% to 1.00%"

"Cu: 0% to 1.00%"

"V: 0% to 1.00%"

"W: 0% to 1.00%"

"Ni: 0% to 3.00%"

Mo, Cr, Cu, V, W, and Ni have a function to increase the strength of the hot-stamping formed body by being dissolved in prior austenite grains in the heating before hot stamping. Accordingly, it is possible to increase the ratio of a high angle boundary by suppressing the deformation of the prior austenite grains in a case where austenite is transformed into bainite or martensite. In order to reliably obtain this effect, it is preferable to contain any one or more of Mo: 0.005% or more, Cr: 0.005% or more, Cu: 0.001% or more, V: 0.0005% or more, W: 0.001% or more, and Ni: 0.001% or more. Meanwhile, since the effect is saturated even though a large amount of these elements is contained, it is preferable that each of the Mo content, the Cr content, the Cu content, the V content, and the W content is set to 1.00% or less and the Ni content is set to 3.00% or less.

"Mg: 0% to 1.00%"

"Zr: 0% to 1.00%"

"Sb: 0% to 1.00%"

"Ca: 0% to 0.10%"

"REM: 0% to 0.30%"

Mg, Zr, Sb, Ca, and REM are elements that improve deformability by suppressing the formation of oxide serving as the origin of fracture and improve the collision characteristics of the hot-stamping formed body. In order to reliably obtain this effect, it is preferable that the content of even any one of Mg, Zr, Sb, Ca, and REM is set to 0.001% or more. Meanwhile, since the effect is saturated even though a large amount of these elements is contained, it is preferable that each of the Mg content, the Zr content, and the Sb content is set to 1.00% or less, the Ca content is set to 0.10% or less, and the REM content is set to 0.30% or less.

In this embodiment, REM refers to a total of 17 elements that are composed of Sc, Y, and lanthanoid and the REM content refers to the total content of these elements.

"B: 0% to 0.0100%"

B is an element that is segregated at a prior austenite grain boundary and suppresses the formation of ferrite and pearlite. In order to reliably exert this effect, it is preferable that the B content is set to 0.0005% or more. Meanwhile, since the effect is saturated even though the B content is more than 0.0100%, it is preferable that the B content is set to 0.0100% or less.

The chemical composition of the above-mentioned hot-stamping formed body may be measured by a general analysis method. For example, the chemical composition of the above-mentioned hot-stamping formed body may be measured using inductively coupled plasma-atomic emission spectrometry (ICP-AES). C and S may be measured using a combustion-infrared absorption method and N may be measured using an inert gas fusion-thermal conductivity method. In a case where a plating layer is provided on the surface of the hot-stamping formed body, the chemical composition may be analyzed after the plating layer is removed by mechanical grinding.

Next, the microstructure of the hot-stamping formed body according to this embodiment will be described.

The hot-stamping formed body according to this embodiment includes a microstructure which includes residual austenite of which an area ratio is 10% or more and less than 20%, fresh martensite of which an area ratio is 5% to 15%, bainite and tempered martensite of which a total area ratio is 65% to 85%, and a remainder in microstructure of which an area ratio is less than 5%, and among grain boundaries of crystal grains of the bainite and the tempered martensite, a ratio of a length of a grain boundary having a rotation angle in a range of 55° to 75° to a total length of a grain boundary having a rotation angle in a range of 4° to 12°, a grain boundary having a rotation angle in a range of 49° to 54°, and the grain boundary (high angle boundary) having a rotation angle in a range of 55° to 75° to the <011> direction as a rotation axis is 30% or more.

In this embodiment, the microstructure at a depth position corresponding to ¼ of a sheet thickness from the surface of the hot-stamping formed body (a region between a depth corresponding to ⅛ of the sheet thickness from the surface and a depth corresponding to ⅜ of the sheet thickness from the surface) is specified. This depth position is an intermediate point between the surface of the hot-stamping formed body and a central position of the sheet thickness, and the microstructure at the depth position typifies the steel structure of the hot-stamping formed body (shows the average microstructure of the entire hot-stamping formed body).

"Residual Austenite: 10% or More and Less than 20%"

By including a predetermined amount of residual austenite, the strain dispersion characteristics are improved in the hot-stamping formed body. In a case where the residual austenite is less than 10% and 20% or more, desired strain dispersion characteristics cannot be obtained. For this reason, the residual austenite is set to be 10% or more and less than 20%.

"Fresh Martensite: 5% to 15%"

The fresh martensite improves the strength of the hot-stamping formed body. When the fresh martensite is less than 5%, the desired strain dispersion characteristics cannot be obtained. Therefore, the fresh martensite is set to 5% or more. The fresh martensite is preferably 7% or more. Meanwhile, when the fresh martensite is more than 15%, a maximum bending angle of the hot-stamping formed body is lowered, that is, the bendability is lowered. Therefore, the fresh martensite is set to 15% or less. The fresh martensite is preferably 12% or less.

"Bainite and Tempered Martensite: The Total Area Ratio is 65% to 85%"

The bainite and tempered martensite improve the strength of the hot-stamping formed body. In a case where the total area ratio of the bainite and tempered martensite is less than 65%, desired strength cannot be obtained. For this reason, the total area ratio of the bainite and tempered martensite is set to 65% or more. The total area ratio of the bainite and tempered martensite is preferably 70% or more. Meanwhile, in a case where the total area ratio of the bainite and tempered martensite is more than 85%, desired strain dispersion characteristics cannot be obtained. For this reason, the total area ratio of the bainite and tempered martensite is set to 85% or less. The total area ratio of the bainite and tempered martensite is preferably 80% or less.

"Remainder in Microstructure: Less than 5%"

Ferrite, pearlite, and granular bainite may be included in the microstructure of the hot-stamping formed body according to this embodiment as the remainder in microstructure. In a case where the area ratio of the remainder in microstructure is high, desired strength and desired collision characteristics cannot be obtained. For this reason, the area ratio of the remainder in microstructure is set to be less than 5%. The area ratio of the remainder in microstructure is preferably 4% or less, 3% or less, 2% or less, or 1% or less.

"Measurement of Area Ratios of Residual Austenite and Bainite and Tempered Martensite"

A sample is cut out from an arbitrary position away from an end surface of the hot-stamping formed body by a distance of 50 mm or more (a position that avoids an end portion in a case where the sample cannot be collected at this position) so that a cross section (sheet thickness-cross section) perpendicular to the surface can be observed. The size of the sample also depends on a measurement device but is set to a size that can be observed by about 10 mm in a rolling direction.

After being polished using silicon carbide paper having a grit of #600 to #1500, the cross section of the sample is finished as a mirror surface using liquid in which diamond powder having a grain size in the range of 1 μm to 6 μm is dispersed in diluted solution of alcohol or the like or pure water. Then, the sample is polished for 8 minutes using colloidal silica not containing alkaline solution at a room temperature, and thus, strain introduced into the surface layer of the sample is removed. A region, which has a length of 50 μm and is present between a depth corresponding to ⅛ of the sheet thickness from the surface and a depth corresponding to ⅜ of the sheet thickness from the surface, is measured at a measurement interval of 0.1 μm at an arbitrary position on the cross section of the sample in a longitudinal direction by an electron backscatter diffraction method, and thus, crystal orientation information is obtained. An EBSD device formed of a schottky emission scanning electron microscope (JSM-7001F manufactured by JEOL Ltd.) and an EBSD detector (DVC5 detector manufactured by TSL Solutions) is used for measurement. In this case, the degree of vacuum in the EBSD device is set to $9.6\times10^{-5}$ Pa or less, an accelerating voltage is set to 15 kV, an irradiation current level is set to 13, and the irradiation level of an electron beam is set to 62. The area ratio of residual austenite is calculated from the obtained crystal orientation information using "Phase Map" function of software "OIM Analysis (registered trademark)" included in an EBSD analysis device. A region where a crystal structure is fcc is determined as residual austenite.

Next, regions where a crystal structure is bcc are determined as bainite, tempered martensite, fresh martensite, granular bainite, and ferrite; regions where a grain average image quality value is less than 60000 in these regions are determined as bainite, tempered martensite, and fresh martensite using "Grain Average Misorientation" function of software "OIM Analysis (registered trademark)" included in the EBSD analysis device; and the sum of the area ratios of these regions is calculated, so that the total area ratio of "bainite, tempered martensite, and fresh martensite" is obtained. The area ratio of fresh martensite, which is obtained by a method to be described later, is subtracted from the total area ratio of "bainite, tempered martensite, and fresh martensite" obtained by the above-mentioned method, so that the total area ratio of "bainite and tempered martensite" is obtained.

"Measurement of Area Ratio of Fresh Martensite and Remainder in Microstructure"

A sample is cut out from an arbitrary position away from an end surface of the hot-stamping formed body by a distance of 50 mm or more (a position that avoids an end portion in a case where the sample cannot be collected at this position) so that a cross section (sheet thickness-cross section) perpendicular to the surface can be observed. The size of the sample also depends on a measurement device but is set to a size that can be observed by about 10 mm in a rolling direction.

After being polished using silicon carbide paper having a grit of #600 to #1500, the cross section of the sample is finished as a mirror surface using liquid in which diamond powder having a grain size in the range of 1 μm to 6 μm is dispersed in diluted solution of alcohol or the like or pure water and Nital etching is performed. Then, photographs having a plurality of visual fields are taken using a schottky emission scanning electron microscope (JSM-7001F manufactured by JEOL Ltd.) in a region that has a length of 50 μm and is present between a depth corresponding to ⅛ of the sheet thickness from the surface and a depth corresponding to ⅜ of the sheet thickness from the surface at an arbitrary position on the cross section of the sample in a longitudinal direction. Evenly spaced grids are drawn in the taken photographs, and structures at grid points are identified. The number of grid points corresponding to each structure is obtained and is divided by the total number of grid points, so that the area ratio of each structure is obtained. The area ratio can be more accurately obtained as the total number of grid points is larger. In this embodiment, grid spacings are set to 2 μm×2 μm and the total number of grid points is set to 1500.

A region where cementite is precipitated in a lamellar shape in the grains is determined as pearlite. A region where luminance is low and a substructure is not recognized is determined as ferrite. Regions where luminance is high and a substructure does not appear after etching are determined as fresh martensite and residual austenite. Regions not corresponding to any of the above-mentioned region are determined as granular bainite. The area ratio of residual austenite obtained by the above-mentioned EBSD analysis is subtracted from the area ratio of fresh martensite and residual austenite obtained from the taken photographs, so that the area ratio of fresh martensite is obtained.

"Among grain boundaries of crystal grains of the bainite and the tempered martensite, ratio of length of grain boundary (high angle boundary) having rotation angle in range of 55° to 75° to total length of length of grain boundary having rotation angle in range of 4° to 12°, length of grain boundary having rotation angle in range of 49° to 54°, and length of grain boundary having rotation angle in range of 55° to 75° to the <011> direction as rotation axis: 30% or more"

The high angle boundary is a grain boundary that has the highest angle among grain boundaries included in the crystal grains of bainite and tempered martensite. The high angle boundary is highly effective in suppressing the propagation of cracks generated at the time of collision. In a case where a ratio of the length of the high angle boundary is less than 30%, desired collision characteristics cannot be obtained in the hot-stamping formed body. For this reason, the ratio of the length of a high angle boundary is set to 30% or more. The ratio of the length of the high angle boundary is preferably 40% or more. The upper limit of a ratio of the length of the high angle boundary is not particularly specified. However, according to the chemical composition and the manufacturing method according to this embodiment, a substantial upper limit thereof is 90%.

"Method of Measuring Ratio of Length of High Angle Boundary"

A sample is cut out from a position away from an end surface of the hot-stamping formed body by a distance of 50 mm or more (a position that avoids an end portion in a case where the sample cannot be collected at this position) so that a cross section (sheet thickness-cross section) perpendicular to the surface can be observed. The sample also depends on a measurement device but is set to have a length that can be observed by about 10 mm in a rolling direction. A depth position of the cut-out sample corresponding to ¼ of a sheet thickness (a region between a depth corresponding to ⅛ of the sheet thickness from the surface and a depth corresponding to ⅜ of the sheet thickness from the surface) is subjected to EBSD analysis at a measurement interval of 0.1 μm, so that crystal orientation information is obtained. Here, the EBSD analysis is performed using an EBSD device formed of a schottky emission scanning electron microscope (JSM-7001F manufactured by JEOL Ltd.) and an EBSD detector (DVC5 detector manufactured by TSL Solutions) in a state where the irradiation level of an electron beam is 62.

Next, regions where a grain average image quality value is less than 60000 are determined as the crystal grains of bainite, tempered martensite, and fresh martensite with regard to the obtained crystal orientation information using "Grain Average Image Quality" function of software "OIM Analysis (registered trademark)" included in the EBSD analysis device; among grain boundaries of these crystal grains, with regard to the grain boundaries of the crystal grains of bainite and tempered martensite, the length of a grain boundary having a rotation angle in the range of 4° to 12°, the length of a grain boundary having a rotation angle in the range of 49° to 54°, and the length of a grain boundary having a rotation angle in the range of 55° to 75° to the <011> direction as a rotation axis are calculated; and a ratio of the length of a grain boundary having a rotation angle in the range of 55° to 75° to the value of the sum of the lengths of the respective grain boundaries is calculated. Accordingly, among the crystal grains of bainite and tempered martensite, the ratio of the length of the grain boundary (high angle boundary) having a rotation angle in the range of 55° to 75° to the total length of the length of the grain boundary having a rotation angle in the range of 4° to 12°, the length of the grain boundary having a rotation angle in the range of 49° to 54°, and the length of the grain boundary (high angle boundary) having a rotation angle in the range of 55° to 75° to the <011> direction as a rotation axis is obtained.

Taken photographs may be obtained by the same method as the method of measuring the area ratio of the remainder in microstructure; fresh martensite may be determined from the crystal grains of bainite, tempered martensite, and fresh martensite; and fresh martensite may be excluded from the crystal grains of bainite, tempered martensite, and fresh martensite. The reason why the grain boundaries of the crystal grains of fresh martensite are not included in the measurement of a high angle boundary is that fresh martensite has high hardness and serves as the origin of fracture.

The length of the grain boundary can be easily calculated in a case where, for example, "Inverse Pole Figure Map" function and "Axis Angle" function of software "OIM Analysis (registered trademark)" included in the EBSD analysis device are used. In these functions, among grain boundaries of the crystal grains of bainite and tempered martensite the total length of the grain boundaries can be calculated in a case where specific rotation angles are specified to an arbitrary direction as a rotation axis. The above-mentioned analysis may be performed over all crystal grains included in a measurement region, and the lengths of the above-mentioned three types of grain boundaries among the grain boundaries of the crystal grains of bainite and tempered martensite to the <011> direction as a rotation axis may be calculated.

"Average dislocation density: $4.0\times 10^{15}$ m/m$^2$ or more"

An average dislocation density of the hot-stamping formed body according to this embodiment may be $4.0\times10^{15}$ m/m$^2$ or more. In a case where the hot-stamping formed body has the above-mentioned chemical composition and includes the above-mentioned microstructure, that is, residual austenite of which the area ratio is 10% or more and less than 20%, the fresh martensite of which the area ratio is 5% to 15%, bainite and tempered martensite of which the total area ratio is 65% to 85%, and a remainder in microstructure of which the area ratio is less than 5%, and among grain boundaries of crystal grains of the bainite and the tempered martensite, a ratio of the length of a grain boundary having a rotation angle in the range of 55° to 75° to the total length of a grain boundary having a rotation angle in the range of 4° to 12°, a grain boundary having a rotation angle in the range of 49° to 54°, and the grain boundary having a rotation angle in the range of 55° to 75° to the <011> direction as a rotation axis is 30% or more, the average dislocation density of the hot-stamping formed body is inevitably $4.0\times10^{15}$ m/m$^2$ or more.

"Measurement of Average Dislocation Density"

A sample is cut out from an arbitrary position away from an end surface of the hot-stamping formed body by a distance of 50 mm or more (a position that avoids an end portion in a case where the sample cannot be collected at this position). The size of the sample also depends on a measurement device but is set to a size that corresponds to about 20 mm square. The thickness of the sample is reduced using a mixed solution that is composed of 48% by volume of distilled water, 48% by volume of hydrogen peroxide solution, and 4% by volume of hydrofluoric acid. In this case, the same thickness is reduced from each of the surface and back of the sample, so that a depth position corresponding to ¼ of the sheet thickness (a region between a depth corresponding to ⅛ of the sheet thickness from the surface and a depth corresponding to ⅜ of the sheet thickness from the surface) is exposed from the surface of the sample not yet depressurized. X-ray diffraction measurement is performed on this exposed surface to specify a plurality of diffraction peaks of a body-centered cubic lattice. An average dislocation density is analyzed from the half-widths of these diffraction peaks, so that the average dislocation density of a surface layer region is obtained. A modified Williamson-Hall method disclosed in "T. Ungar, three others, Journal of Applied Crystallography, 1999, Vol. 32, pp. 992 to 1002" is used as an analysis method.

"Lath Width of Crystal Grains Having Body-Centered Structure: 200 nm or Less"

A lath width of crystal grains, which have body-centered structure, of the hot-stamping formed body according to this embodiment may be 200 nm or less. In a case where the hot-stamping formed body has the above-mentioned chemical composition and includes the above-mentioned microstructure, that is, residual austenite of which the area ratio is 10% or more and less than 20%, the fresh martensite of which the area ratio is 5% to 15%, bainite and tempered martensite of which the total area ratio is 65% to 85%, and a remainder in microstructure of which the area ratio is less than 5%, and among grain boundaries of crystal grains of the bainite and the tempered martensite, a ratio of the length of a grain boundary having a rotation angle in the range of 55° to 75° to the total length of a grain boundary having a rotation angle in the range of 4° to 12°, a grain boundary having a rotation angle in the range of 49° to 54°, and the grain boundary having a rotation angle in the range of 55° to 75° to the <011> direction as a rotation axis is 30% or more, the lath width of crystal grains having body-centered structure is inevitability 200 nm or less.

In a case where the lath width of crystal grains having body-centered structure is 200 nm or less, an effect of refining crystal grains is obtained. Accordingly, desired tensile strength can be obtained. Preferably, the lath width of crystal grains is 180 nm or less. Since it is more preferable as the lath width of crystal grains is smaller, the lower limit of the lath width is not particularly specified.

"Measurement of Lath Width of Crystal Grains Having Body-Centered Structure"

A sample is cut out from a position away from an end surface of the hot-stamping formed body by a distance of 50 mm or more (a position that avoids an end portion in a case where the sample cannot be collected at this position) so that a cross section (sheet thickness-cross section) perpendicular to the surface can be observed. The sample also depends on a measurement device but is set to have a length that can be observed by about 10 mm in a rolling direction. A depth position of the cut-out sample corresponding to ¼ of a sheet thickness (a region between a depth corresponding to ⅛ of the sheet thickness from the surface and a depth corresponding to ⅜ of the sheet thickness from the surface) is subjected to EBSD analysis at a measurement interval of 0.1 μm, so that crystal orientation information is obtained. Here, the EBSD analysis is performed using an EBSD device formed of a schottky emission scanning electron microscope (JSM-7001F manufactured by JEOL Ltd.) and an EBSD detector (DVC5 detector manufactured by TSL Solutions) in a state where the irradiation level of an electron beam is 62.

Next, an Invere Pole Figure image of only crystal grains having body-centered structure is drawn with regard to the obtained crystal orientation information using "Invere Pole Figure" function of software "OIM Analysis (registered trademark)" included in the EBSD analysis device, crystal grains of which a crystal misorientation is 8° or less is regarded as one lath (generally, called a block but expressed as a lath in this embodiment), and the length of the lath in a minor axis direction is measured. The lengths of 20 or more laths in the minor axis direction are measured and an average value of the lengths is calculated, so that the lath width of the crystal grains having body-centered structure is obtained.

"Sheet Thickness and Tensile Strength"

The sheet thickness of the hot-stamping formed body according to this embodiment is not particularly limited. However, in terms of reducing the weight of a vehicle body, it is preferable that the sheet thickness of the hot-stamping formed body according to this embodiment is set to the range of 0.5 mm to 3.5 mm. Further, in terms of reducing the weight of a vehicle body, it is preferable that the tensile strength of the hot-stamping formed body is set to 1500 MPa or more. More preferably, the tensile strength of the hot-stamping formed body is 1800 MPa or more or 2000 MPa or more. The upper limit of the tensile strength is not particularly specified, but may be set to 2600 MPa or less.

"Plating Layer"

For the purpose of improving corrosion resistance and the like, a plating layer may be formed on the surface of the hot-stamping formed body according to this embodiment. The plating layer may be any of an electroplating layer and a hot-dip plating layer. The electroplating layer includes, for example, an electrogalvanized layer, an electrolytic Zn—Ni alloy plating layer, and the like. The hot-dip plating layer includes, for example, a hot-dip galvanized layer, a hot-dip galvannealed layer, a hot-dip aluminum plating layer, a hot-dip Zn—Al alloy plating layer, a hot-dip Zn—Al—Mg alloy plating layer, a hot-dip Zn—Al—Mg—Si alloy plating layer, and the like. An adhesion amount of a plating layer is not particularly limited and may be a general adhesion amount.

"Method of Manufacturing Hot-Stamping Formed Body"

Next, a preferred method of manufacturing the hot-stamping formed body according to this embodiment will be described.

The hot-stamping formed body according to this embodiment can be manufactured by performing hot stamping on a cold-rolled steel sheet manufactured by a routine method or a cold-rolled steel sheet including a plating layer on the surface thereof, holding the cold-rolled steel sheet in a low temperature range after the hot stamping, and then cooling the cold-rolled steel sheet.

"Heating and Holding Before Hot Stamping"

It is preferable that the cold-rolled steel sheet is held for 60 sec to 600 sec in the temperature range of 800° C. to 1000° C. before the hot stamping. In a case where a heating temperature is lower than 800° C. or a holding time is less than 60 sec, the cold-rolled steel sheet cannot be sufficiently austenitized. For this reason, a desired amount of bainite and tempered martensite may not be capable of being obtained in the hot-stamping formed body. In a case where a heating temperature is more than 1000° C. or a holding time is more than 600 sec, transformation into bainite and tempered martensite is delayed due to an increase in austenite grain size. For this reason, a desired amount of bainite and tempered martensite may not be capable of being obtained.

An average heating rate during the heating may be set to 0.1° C./s or more or 200° C./s or less. The average heating rate mentioned here is a value of a difference between a surface temperature of a steel sheet at the heating start and a holding temperature divided by a difference between the time at the heating start and a time when a temperature reaches a holding temperature. Further, during the holding, the temperature of a steel sheet may be fluctuated in the temperature range of 800° C. to 1000° C. or may be constant.

Examples of a heating method before the hot stamping include heating using an electric furnace, a gas furnace, or the like, flame heating, energization heating, high-frequency heating, induction heating, and the like.

"Cooling after Hot Stamping"

Hot stamping is performed after the heating and the holding described above. After the hot stamping, it is preferable that cooling is performed at an average cooling rate of 1.0° C./s to 100° C./s up to the temperature range of 150° C. to 300° C. In a case where a cooling stop temperature is lower than 150° C. in the cooling after the hot stamping, the introduction of lattice defects is excessively facilitated. For this reason, desired dislocation density may not be capable of being obtained. In a case where a cooling stop temperature is more than 300° C., the hardness of prior austenite grains is reduced. For this reason, a desired number of high angle boundaries may not be capable of being formed. Further, in a case where an average cooling rate is lower than 1.0° C./s, transformation into ferrite, granular bainite, or pearlite is facilitated. For this reason, a desired amount of bainite and tempered martensite may not be capable of being obtained. In a case where an average cooling rate is more than 100° C./s, the driving force of transformation into tempered martensite and bainite is increased and an action for relieving strain to be introduced by transformation is reduced. For this reason, it is difficult to obtain a desired number of high angle boundaries. The average cooling rate mentioned here is a value of the difference in the surface temperatures between at the cooling start and at the cooling end divided by time difference between the cooling start and the cooling end.

"Holding at Low Temperature"

It is preferable that holding at low temperature is performed in the temperature range of 150° C. to 300° C. for 1.0 hour to 50 hours. During the holding at low temperature, carbon is distributed to untransformed austenite from martensite that is transformed from austenite. Austenite on which carbon is concentrated is not transformed into martensite and remains as residual austenite even after the finish of cooling after the holding at low temperature. Further, since austenite on which carbon is concentrated has high hardness in a case where holding at low temperature is performed under the above-mentioned conditions, the ratio of a high angle boundary can be increased.

In a case where a holding temperature is lower than 150° C. or a holding time is less than 1.0 hour, carbon is not sufficiently distributed to untransformed austenite from martensite. For this reason, a desired amount of residual austenite may not be capable of being obtained. Further, the ratio of a high angle boundary is reduced. In a case where a holding temperature is more than 300° C., the hardness of prior austenite grains is reduced. For this reason, a desired number of high angle boundaries may not be capable of being obtained. When the holding time is more than 50 hours, the desired fresh martensite may not be capable of being obtained. During the holding at low temperature, the temperature of a steel sheet may be fluctuated in the temperature range of 150° C. to 300° C. or may be constant.

The holding at low temperature is not particularly limited, but for example, the steel sheet after the hot stamping may be transported to a heating furnace.

In a case where the steel sheet is heated in the temperature range of 300° C. or more after hot stamping and cooling and before holding at low temperature, bainite is generated. As a result, a desired number of high angle boundaries cannot be obtained. For this reason, in a case where the hot-stamping formed body according to this embodiment is to be manufactured, it is not preferable that the steel sheet is heated in the temperature range of 300° C. or more after hot stamping and cooling and before holding at low temperature.

"Cooling after Holding at Low Temperature"

It is preferable that the steel sheet is cooled up to a temperature of 80° C. or less at an average cooling rate of 1.0° C./s to 100° C./s after the holding at low temperature. In a case where the average cooling rate is lower than 1.0° C./s or a cooling stop temperature is more than 80° C., residual austenite may be decomposed. For this reason, a desired amount of residual austenite may not be capable of being obtained. In a case where an average cooling rate is more than 100° C./s, a load is applied to a cooling device. An average cooling rate mentioned here is a value of the difference in the surface temperatures between at the time of start of the cooling after the holding at low temperature and at the time of end of the cooling divided by time difference between the cooling start and the cooling end.

EXAMPLES

Next, examples of the present invention will be described. Conditions in the examples are one condition example that is employed to confirm the feasibility and effects of the present invention, and the present invention is not limited to this condition example. The present invention may employ various conditions to achieve the object of the present invention without departing from the scope of the present invention.

Hot rolling and cold rolling were performed on steel pieces manufactured by the casting of molten steel having the chemical composition shown in Tables 1 and 2, and plating was performed on the steel pieces as necessary, so that cold-rolled steel sheets were obtained. Then, hot-stamping formed bodies were manufactured using the cold-rolled steel sheets under conditions shown in Tables 3 to 5.

An average heating rate during heating before hot stamping was set to 0.1° C./s to 200° C./s, cooling after hot stamping was performed up to the temperature range of 150° C. to 300° C., and cooling after holding at low temperature was performed up to a temperature of 80° C. or less. Further, Manufacture No. 18 of Table 3 was provided with a hot-dip aluminum plating layer and Manufacture No. 19 of Table 3 was provided with a hot-dip galvanized layer.

Manufacture No. 57 was held for 30 sec in the temperature range of 300° to 560° after hot stamping and cooling, and before holding at low temperature holding, and was then subjected to holding at low temperature shown in Table 5.

An underline in Tables represents that a condition is out of the range of the present invention, a condition is out of a preferred manufacturing condition, or a characteristic value is not preferred. In Tables 3-5, γr denotes residual austenite, FM denotes fresh martensite, B denotes bainite, and TM denotes tempered martensite.

With regard to the microstructure of the hot-stamping formed body, the measurement of the area ratio of each structure, the measurement of a ratio of the length of a high angle boundary, the measurement of dislocation density, and the measurement of the lath width of crystal grains having body-centered structure were performed by the above-mentioned measurement methods. Further, the mechanical characteristics of the hot-stamping formed body were evaluated by the following methods.

"Tensile Strength"

No. 5 test pieces described in JIS Z 2241:2011 were prepared from an arbitrary position of the hot-stamping formed body, and the tensile strength of the hot-stamping formed body was obtained according to a test method described in JIS Z 2241:2011. The speed of a cross-head was set to 3 mm/min. The test piece was determined to be acceptable since being excellent in strength in a case where tensile strength was 1500 MPa or more, and was determined to be unacceptable since being inferior in strength in a case where tensile strength was less than 1500 MPa.

"Collision Characteristics (Strain Dispersion Characteristics Evaluation)"

In evaluating the collision characteristics (strain dispersion characteristics and bendability) of the hot-stamping formed body, in this example, based on the VDA standard (VDA238-100) specified by the German Association of the Automotive Industry, the maximum bending angle and the deformation region at the bending angle of 40° were evaluated. The VDA test was conducted under the following conditions.

In this example, when the maximum bending angle obtained by the VDA test was 60° or more, it was determined to be excellent in bendability and determined to be acceptable, and when the maximum bending angle was less than 60°, it was determined to be inferior in bendability and determined to be unacceptable.

Dimensions of test piece: 60 mm (rolling direction)×30 mm (a direction parallel to a sheet width direction)

Sheet thickness of test piece: 1.01 to 1.05 mm (the surface and back were ground by the same amount)

Bending ridge: a direction parallel to a sheet width direction

Test method: roll support and punch pressing

Roll diameter: φ 30 mm

Punch shape: tip end R=0.4 mm

Roll-to-roll distance: 2.0× sheet thickness (mm)+0.5 mm

Pressing speed: 20 mm/min

Testing machine: AG-100KNI manufactured by Shimadzu Corporation

The strain dispersion characteristics were evaluated in the deformation region at a bending angle of 40° after the VDA bending test. At the center portion of the surface of the test piece before being subjected to the VDA test, 10 lattice-like grits at 100 μm intervals in the width direction×20 lattice-like grits in the length direction (200 in total) were engraved by laser irradiation. The VDA test was performed under the same test conditions as above, and the test was stopped when the bending angle reached 40°. Using a laser microscope, an interstitial distance in the direction perpendicular to the bending ridge was measured in each lattice, and the value was calculated by dividing it by 100 μm to obtain an amount of deformation in each lattice. The length of the deformation region was obtained by calculating the total length of the interstitial distances in the direction perpendicular to the bending ridge of the lattice having the amount of deformation of 1.05 or more. In this example, when the length of the deformation region was 500 μm or more, it was determined to be excellent in the strain dispersion characteristics and determined to be acceptable, and when the length of the deformation region was less than 500 μm, it was determined to be inferior in the strain dispersion characteristics and determined to be unacceptable.

It is found from Tables 3 to 5 that a hot-stamping formed body of which the chemical composition and the microstructure are in the range of the present invention has excellent strength and collision characteristics.

Meanwhile, it is found that a hot-stamping formed body of which any one or more of the chemical composition and the microstructure is out of the present invention is inferior in one or more of strength and collision characteristics.

TABLE 1

| Steel | Chemical composition (mass %) Remainder of Fe and impurities | | | | | | | | | |
|---|---|---|---|---|---|---|---|---|---|---|
| No. | C | Si | Mn | Al | Co | P | S | N | Others | Note |
| 1 | 0.18 | 1.76 | 3.15 | 0.442 | 0.102 | 0.006 | 0.0019 | 0.0046 | | Steel of invention |
| 2 | 0.55 | 0.98 | 3.49 | 0.312 | 0.104 | 0.007 | 0.0005 | 0.0048 | | Steel of invention |
| 3 | 0.47 | 0.62 | 3.40 | 0.313 | 0.109 | 0.004 | 0.0021 | 0.0032 | | Steel of invention |
| 4 | 0.50 | 2.90 | 3.37 | 0.535 | 0.114 | 0.006 | 0.0027 | 0.0053 | | Steel of invention |
| 5 | 0.53 | 1.86 | 3.11 | 0.369 | 0.105 | 0.011 | 0.0021 | 0.0033 | | Steel of invention |
| 6 | 0.46 | 0.97 | 4.79 | 0.509 | 0.126 | 0.008 | 0.0023 | 0.0039 | | Steel of invention |
| 7 | 0.54 | 1.03 | 3.29 | 0.120 | 0.100 | 0.003 | 0.0027 | 0.0048 | | Steel of invention |
| 8 | 0.51 | 1.82 | 3.32 | 2.880 | 0.110 | 0.008 | 0.0007 | 0.0043 | | Steel of invention |
| 9 | 0.50 | 1.85 | 3.21 | 0.340 | 0.181 | 0.086 | 0.0017 | 0.0052 | | Steel of invention |
| 10 | 0.46 | 1.10 | 3.38 | 0.401 | 2.785 | 0.086 | 0.0026 | 0.0035 | | Steel of invention |
| 11 | 0.45 | 1.66 | 3.17 | 0.743 | 0.121 | 0.083 | 0.0021 | 0.0030 | | Steel of invention |
| 12 | 0.51 | 1.65 | 3.34 | 0.669 | 0.109 | 0.001 | 0.0013 | 0.0049 | | Steel of invention |
| 13 | 0.50 | 1.21 | 3.36 | 0.804 | 0.146 | 0.006 | 0.0781 | 0.0030 | | Steel of invention |

TABLE 1-continued

| Steel No. | Chemical composition (mass %) Remainder of Fe and impurities C | Si | Mn | Al | Co | P | S | N | Others | Note |
|---|---|---|---|---|---|---|---|---|---|---|
| 14 | 0.55 | 1.07 | 3.40 | 0.620 | 0.114 | 0.006 | 0.0005 | 0.0049 | | Steel of invention |
| 15 | 0.49 | 1.56 | 3.37 | 0.481 | 0.117 | 0.010 | 0.0016 | 0.0075 | | Steel of invention |
| 16 | 0.52 | 1.23 | 3.25 | 0.424 | 0.129 | 0.004 | 0.0033 | 0.0006 | | Steel of invention |
| 17 | 0.51 | 1.80 | 3.01 | 0.460 | 0.150 | 0.005 | 0.0025 | 0.0032 | | Steel of invention |
| 18 | 0.46 | 1.71 | 3.07 | 0.434 | 0.120 | 0.004 | 0.0025 | 0.0033 | | Steel of invention |
| 19 | 0.42 | 1.69 | 3.11 | 0.447 | 0.122 | 0.005 | 0.0023 | 0.0034 | | Steel of invention |
| 20 | 0.49 | 1.77 | 3.36 | 0.500 | 0.131 | 0.009 | 0.0031 | 0.0045 | Nb: 0.07 | Steel of invention |
| 21 | 0.52 | 1.18 | 3.50 | 0.786 | 0.142 | 0.004 | 0.0012 | 0.0030 | Ti: 0.013 | Steel of invention |
| 22 | 0.54 | 1.04 | 3.49 | 0.402 | 0.110 | 0.010 | 0.0016 | 0.0051 | Mo: 0.15 | Steel of invention |
| 23 | 0.45 | 1.54 | 3.41 | 0.662 | 0.153 | 0.011 | 0.0016 | 0.0033 | Cr: 0.34 | Steel of invention |
| 24 | 0.51 | 1.76 | 3.30 | 0.753 | 0.149 | 0.012 | 0.0021 | 0.0047 | Cu: 0.17 | Steel of invention |
| 25 | 0.54 | 1.53 | 3.50 | 0.334 | 0.151 | 0.006 | 0.0014 | 0.0035 | V: 0.21 | Steel of invention |

TABLE 2

| Steel No. | Chemical composition (mass %) Remainder of Fe and impurities C | Si | Mn | Al | Co | P | S | N | Others | Note |
|---|---|---|---|---|---|---|---|---|---|---|
| 26 | 0.50 | 1.61 | 3.20 | 0.417 | 0.139 | 0.005 | 0.0026 | 0.0028 | W: 0.22 | Steel of invention |
| 27 | 0.49 | 1.47 | 3.26 | 0.351 | 0.121 | 0.011 | 0.0028 | 0.0029 | Ni: 0.35 | Steel of invention |
| 28 | 0.49 | 1.39 | 3.14 | 0.453 | 0.148 | 0.010 | 0.0027 | 0.0036 | Mg: 0.04 | Steel of invention |
| 29 | 0.46 | 1.62 | 3.33 | 0.373 | 0.114 | 0.011 | 0.0025 | 0.0050 | Zr: 0.02 | Steel of invention |
| 30 | 0.49 | 1.67 | 3.22 | 0.563 | 0.109 | 0.005 | 0.0019 | 0.0046 | Sb: 0.02 | Steel of invention |
| 31 | 0.55 | 1.42 | 3.34 | 0.499 | 0.128 | 0.011 | 0.0026 | 0.0034 | B: 0.0025 | Steel of invention |
| 32 | 0.45 | 1.40 | 3.40 | 0.414 | 0.136 | 0.008 | 0.0030 | 0.0031 | Ca: 0.03 | Steel of invention |
| 33 | 0.49 | 1.21 | 3.24 | 0.421 | 0.125 | 0.009 | 0.0016 | 0.0035 | REM: 0.15 | Steel of invention |
| 34 | 1.20 | 1.12 | 3.51 | 0.774 | 0.136 | 0.007 | 0.0023 | 0.0044 | | Comparative steel |
| 35 | 0.12 | 1.52 | 3.49 | 0.495 | 0.118 | 0.006 | 0.0008 | 0.0032 | | Comparative steel |
| 36 | 0.51 | 0.23 | 3.18 | 0.732 | 0.112 | 0.011 | 0.0026 | 0.0042 | | Comparative steel |
| 37 | 0.55 | 3.28 | 3.23 | 0.595 | 0.148 | 0.010 | 0.0008 | 0.0048 | | Comparative steel |
| 38 | 0.47 | 1.15 | 2.88 | 0.309 | 0.125 | 0.005 | 0.0008 | 0.0047 | | Comparative steel |
| 39 | 0.50 | 1.59 | 5.12 | 0.413 | 0.116 | 0.005 | 0.0020 | 0.0043 | | Comparative steel |
| 40 | 0.53 | 1.18 | 3.54 | 0.051 | 0.131 | 0.010 | 0.0019 | 0.0049 | | Comparative steel |
| 41 | 0.50 | 1.05 | 3.39 | 3.310 | 0.105 | 0.007 | 0.0022 | 0.0046 | | Comparative steel |
| 42 | 0.46 | 1.32 | 3.22 | 0.320 | 0.071 | 0.006 | 0.0021 | 0.0049 | | Comparative steel |
| 43 | 0.54 | 1.12 | 3.21 | 0.460 | 3.223 | 0.006 | 0.0021 | 0.0049 | | Comparative steel |
| 44 | 0.53 | 1.83 | 3.20 | 0.605 | 0.145 | 0.211 | 0.0011 | 0.0053 | | Comparative steel |
| 45 | 0.55 | 1.12 | 3.38 | 0.459 | 0.108 | 0.008 | 0.1802 | 0.0031 | | Comparative steel |
| 46 | 0.47 | 1.12 | 3.41 | 0.458 | 0.115 | 0.008 | 0.0027 | 0.0212 | | Comparative steel |

An underline represents that a condition is out of the range of the present invention.

TABLE 3

| Manufacture No. | Steel No. | Heating: Heating temperature (° C.) | Heating: Holding time (s) | Cooling after HS Average cooling rate until holding at low temperature (° C./s) | Holding at low temperature: Holding temperature (° C.) | Holding at low temperature: Holding time (h) | Cooling after holding at low temperature: Average cooling rate (° C./s) | Microstructure: γr (area %) | Microstructure: FM (area %) |
|---|---|---|---|---|---|---|---|---|---|
| 1 | 1 | 888 | 380 | 5 | 183 | 25 | 9 | 18 | 8 |
| 2 | 2 | 916 | 364 | 10 | 183 | 26 | 15 | 17 | 7 |
| 3 | 3 | 888 | 356 | 10 | 205 | 20 | 13 | 13 | 9 |
| 4 | 4 | 907 | 320 | 6 | 210 | 21 | 18 | 18 | 9 |
| 5 | 5 | 903 | 380 | 4 | 192 | 25 | 19 | 16 | 9 |
| 6 | 6 | 893 | 354 | 4 | 191 | 23 | 9 | 16 | 6 |
| 7 | 7 | 882 | 259 | 8 | 202 | 28 | 20 | 15 | 7 |
| 8 | 8 | 904 | 317 | 8 | 206 | 21 | 15 | 18 | 9 |
| 9 | 9 | 932 | 283 | 9 | 193 | 20 | 8 s | 19 | 9 |
| 10 | 10 | 916 | 346 | 10 | 194 | 21 | 15 | 17 | 8 |
| 11 | 11 | 887 | 357 | 7 | 194 | 22 | 19 | 19 | 6 |
| 12 | 12 | 926 | 293 | 7 | 195 | 23 | 17 | 15 | 10 |
| 13 | 13 | 933 | 363 | 7 | 206 | 24 | 5 | 16 | 6 |
| 14 | 14 | 896 | 309 | 9 | 202 | 27 | 8 | 17 | 7 |
| 15 | 15 | 908 | 231 | 3 | 210 | 27 | 20 | 15 | 10 |
| 16 | 16 | 933 | 247 | 9 | 210 | 23 | 11 | 17 | 6 |

TABLE 3-continued

| | | | | | | | | | |
|---|---|---|---|---|---|---|---|---|---|
| 17 | 17 | 918 | 273 | 3 | 192 | 23 | 16 | 17 | 9 |
| 18 | 18 | 893 | 373 | 10 | 185 | 20 | 9 | 15 | 7 |
| 19 | 19 | 920 | 368 | 9 | 185 | 27 | 10 | 19 | 6 |
| 20 | 20 | 881 | 354 | 4 | 208 | 26 | 20 | 18 | 10 |

| | Microstructure | | | | | Mechanical characteristics | | | |
|---|---|---|---|---|---|---|---|---|---|
| Manufacture No. | B + TM (area %) | Remainder (area %) | Ratio of length of grain boundary having rotation angle in range of 55° to 75° (%) | Dislocation density ($10^{15}$ m/m$^2$) | Lath width (nm) | Tensile strength (MPa) | Maximum bending angle (°) | Deformation region (μm) | Note |
| 1 | 71 | 3 | 43 | 4.2 | 191 | 1560 | 78 | 623 | Example of invention |
| 2 | 74 | 2 | 44 | 7.2 | 152 | 2510 | 66 | 603 | Example of invention |
| 3 | 77 | 1 | 51 | 5.2 | 172 | 2027 | 61 | 509 | Example of invention |
| 4 | 69 | 4 | 58 | 4.5 | 177 | 2412 | 71 | 612 | Example of invention |
| 5 | 72 | 3 | 32 | 5.9 | 170 | 2249 | 62 | 693 | Example of invention |
| 6 | 75 | 3 | 53 | 5.3 | 161 | 2304 | 63 | 614 | Example of invention |
| 7 | 77 | 1 | 57 | 6.5 | 186 | 2185 | 64 | 64C | Example of invention |
| 8 | 70 | 3 | 55 | 4.5 | 164 | 2106 | 63 | 552 | Example of invention |
| 9 | 70 | 2 | 33 | 4.9 | 163 | 2248 | 64 | 661 | Example of invention |
| 10 | 73 | 2 | 71 | 4.9 | 181 | 2011 | 78 | 683 | Example of invention |
| 11 | 71 | 4 | 41 | 6.5 | 171 | 2348 | 61 | 618 | Example of invention |
| 12 | 74 | 1 | 43 | 5.9 | 171 | 2370 | 75 | 602 | Example of invention |
| 13 | 77 | 1 | 43 | 6.0 | 179 | 2299 | 62 | 582 | Example of invention |
| 14 | 74 | 2 | 59 | 5.6 | 180 | 2025 | 77 | 691 | Example of invention |
| 15 | 78 | 1 | 48 | 4.5 | 186 | 2227 | 65 | 515 | Example of invention |
| 16 | 74 | 3 | 60 | 5.2 | 184 | 2239 | 74 | 619 | Example of invention |
| 17 | 72 | 2 | 45 | 6.5 | 171 | 2405 | 72 | 648 | Example of invention |
| 18 | 75 | 3 | 56 | 4.5 | 167 | 2409 | 72 | 650 | Example of invention |
| 19 | 72 | 3 | 50 | 4.9 | 161 | 2090 | 70 | 568 | Example of invention |
| 20 | 68 | 4 | 69 | 6.4 | 176 | 2179 | 78 | 546 | Example of invention |

TABLE 4

| | | Heating | | Cooling after HS Average cooling rate until holding | Holding at low temperature | | Cooling after holding at low temperature Average | Microstructure | |
|---|---|---|---|---|---|---|---|---|---|
| Manufacture No. | Steel No. | Heating temperature (° C.) | Holding time (s) | at low temperature (° C./s) | Holding temperature (° C.) | Holding time (h) | cooling rate (° C./s) | γr (area %) | FM (area %) |
| 21 | 21 | 894 | 236 | 3 | 192 | 28 | 5 | 17 | 6 |
| 22 | 22 | 881 | 353 | 9 | 203 | 23 | 16 | 19 | 7 |
| 23 | 23 | 911 | 307 | 6 | 181 | 27 | 5 | 19 | 8 |
| 24 | 24 | 885 | 265 | 9 | 183 | 26 | 6 | 16 | 7 |
| 25 | 25 | 936 | 278 | 10 | 210 | 20 | 8 | 17 | 8 |
| 26 | 26 | 918 | 364 | 6 | 201 | 22 | 19 | 18 | 10 |
| 27 | 27 | 899 | 264 | 10 | 186 | 27 | 15 | 16 | 9 |
| 28 | 28 | 894 | 311 | 5 | 204 | 27 | 18 | 16 | 7 |

TABLE 4-continued

| | | | | | | | | | |
|---|---|---|---|---|---|---|---|---|---|
| 29 | 29 | 931 | 361 | 7 | 199 | 20 | 13 | 15 | 6 |
| 30 | 30 | 912 | 304 | 7 | 187 | 23 | 13 | 17 | 10 |
| 31 | 31 | 934 | 296 | 5 | 203 | 26 | 12 | 19 | 6 |
| 32 | 32 | 899 | 320 | 9 | 183 | 28 | 13 | 16 | 8 |
| 33 | 33 | 917 | 301 | 4 | 196 | 25 | 15 | 18 | 8 |
| 34 | 34 | 885 | 272 | 5 | 184 | 26 | 18 | 15 | 9 |
| 35 | 35 | 888 | 242 | 6 | 195 | 23 | 18 | 17 | 8 |
| 36 | 36 | 913 | 288 | 9 | 207 | 24 | 16 | 8 | 10 |
| 37 | 37 | 939 | 368 | 5 | 191 | 21 | 13 | 16 | 8 |
| 38 | 38 | 883 | 377 | 5 | 207 | 27 | 8 | 18 | 8 |
| 39 | 39 | 909 | 339 | 9 | 210 | 28 | 5 | 17 | 7 |
| 40 | 40 | 903 | 275 | 9 | 184 | 20 | 18 | 17 | 7 |

| | | | Microstructure Ratio of length of | | | Mechanical characteristics | | | |
|---|---|---|---|---|---|---|---|---|---|
| Manufacture No. | B + TM (area %) | Remainder (are a%) | grain boundary having rotation angle in range of 55° to 75° (%) | Dislocation density ($10^{15}$ m/m$^2$) | Lath width (nm) | Tensile strength (MPa) | Maximum bending angle (°) | Deformation region (μm) | Note |
| 21 | 75 | 2 | 71 | 5.8 | 171 | 2352 | 80 | 677 | Example of invention |
| 22 | 71 | 3 | 74 | 4.6 | 183 | 2290 | 80 | 533 | Example of invention |
| 23 | 71 | 2 | 76 | 6.4 | 189 | 2292 | 79 | 684 | Example of invention |
| 24 | 75 | 2 | 73 | 4.7 | 173 | 2370 | 80 | 664 | Example of invention |
| 25 | 72 | 3 | 74 | 5.5 | 170 | 2165 | 80 | 604 | Example of invention |
| 26 | 70 | 2 | 75 | 5.3 | 189 | 2228 | 80 | 537 | Example of invention |
| 27 | 71 | 4 | 71 | 6.3 | 180 | 2406 | 77 | 617 | Example of invention |
| 28 | 76 | 1 | 58 | 5.5 | 186 | 2213 | 78 | 658 | Example of invention |
| 29 | 77 | 2 | 53 | 4.5 | 177 | 2259 | 79 | 634 | Example of invention |
| 30 | 69 | 4 | 57 | 5.3 | 176 | 2060 | 78 | 526 | Example of invention |
| 31 | 74 | 1 | 40 | 6.4 | 183 | 2000 | 78 | 665 | Example of invention |
| 32 | 72 | 4 | 43 | 6.0 | 165 | 2265 | 76 | 696 | Example of invention |
| 33 | 70 | 4 | 42 | 5.9 | 162 | 2384 | 78 | 672 | Example of invention |
| 34 | 72 | 4 | 52 | 4., | 280 | 1210 | 71 | 601 | Comparative Example |
| 35 | 74 | 1 | 40 | 5.3 | 188 | 1320 | 74 | 671 | Comparative Example |
| 36 | 79 | 3 | 54 | 4.5 | 181 | 2272 | 68 | 451 | Comparative Example |
| 37 | 68 | 8 | 48 | 3.1 | 162 | 2227 | 55 | 646 | Comparative Example |
| 38 | 72 | 2 | 21 | 5.1 | 170 | 2157 | 51 | 554 | Comparative Example |
| 39 | 73 | 3 | 42 | 5.9 | 167 | 1410 | 70 | 579 | Comparative Example |
| 40 | 72 | 4 | 53 | 6.5 | 160 | 2109 | 41 | 678 | Comparative Example |

An underline represents that a condition is out of the range of the present invention, a manufacturing condition is not preferred, or characteristics are not preferred.

TABLE 5

| Manufacture No | Steel No. | Heating: Heating temperature (° C.) | Heating: Holding time (s) | Cooling after HS Average cooling rate until holding at low temperature (° C./s) | Holding at low temperature: Holding temperature (° C.) | Holding at low temperature: Holding time (h) | Cooling after holding at low temperature: Average cooling rate (° C./s) | Microstructure: γr (area %) | Microstructure: FM (area %) |
|---|---|---|---|---|---|---|---|---|---|
| 41 | 41 | 890 | 354 | 7 | 194 | 27 | 5 | 19 | 7 |
| 42 | 42 | 921 | 336 | 3 | 202 | 27 | 7 | 18 | 10 |
| 43 | 43 | 936 | 288 | 3 | 207 | 20 | 13 | 18 | 10 |
| 44 | 44 | 901 | 294 | 7 | 198 | 24 | 5 | 15 | 7 |
| 45 | 45 | 935 | 285 | 10 | 208 | 27 | 10 | 17 | 10 |
| 46 | 46 | 923 | 376 | 8 | 198 | 27 | 10 | 17 | 6 |
| 47 | 17 | 780 | 372 | 4 | 192 | 22 | 11 | 16 | 8 |
| 48 | 17 | 1080 | 376 | 8 | 200 | 27 | 17 | 19 | 6 |
| 49 | 17 | 910 | 46 | 5 | 192 | 24 | 10 | 17 | 10 |
| 50 | 17 | 923 | 712 | 9 | 206 | 28 | 5 | 18 | 10 |
| 51 | 17 | 932 | 247 | 0.4 | 206 | 28 | 17 | 18 | 9 |
| 52 | 17 | 883 | 273 | 110 | 202 | 21 | 19 | 17 | 8 |
| 53 | 17 | 902 | 332 | 6 | 132 | 22 | 7 | 6 | 10 |
| 54 | 17 | 932 | 281 | 4 | 317 | 21 | 18 | 17 | 6 |
| 55 | 17 | 916 | 321 | 3 | 206 | 57 | 6 | 15 | 2 |
| 56 | 17 | 934 | 339 | 3 | 203 | 0.5 | 8 | 6 | 6 |
| 57* | 17 | 917 | 287 | 8 | 206 | 23 | 14 | 16 | 6 |

| Manufacture No | Microstructure: B + TM (area %) | Microstructure: Remainder (area %) | Microstructure: Ratio of length of grain boundary having rotation angle in range of 55° to 75 (%) | Microstructure: Dislocation density ($10^{15}$ m/m$^2$) | Microstructure: Lath width (nm) | Mechanical characteristics: Tensile strength (MPa) | Mechanical characteristics: Maximum bending angle (°) | Mechanical characteristics: Deformation region (μm) | Note |
|---|---|---|---|---|---|---|---|---|---|
| 41 | 70 | 4 | 54 | 5.2 | 174 | 2008 | 36 | 544 | Comparative Example |
| 42 | 53 | 19 | 22 | 2.9 | 182 | 2441 | 54 | 697 | Comparative Example |
| 43 | 68 | 4 | 50 | 6.0 | 177 | 1231 | 74 | 700 | Comparative Example |
| 44 | 75 | 3 | 42 | 5.4 | 166 | 2345 | 44 | 515 | Comparative Example |
| 45 | 72 | 1 | 50 | 5.1 | 184 | 2241 | 46 | 512 | Comparative Example |
| 46 | 76 | 1 | 47 | 4.6 | 160 | 2137 | 54 | 658 | Comparative Example |
| 47 | 57 | 19 | 50 | 2.7 | 162 | 2144 | 47 | 559 | Comparative Example |
| 48 | 63 | 12 | 57 | 2.8 | 189 | 2391 | 45 | 544 | Comparative Example |
| 49 | 66 | 7 | 58 | 3.2 | 169 | 2394 | 46 | 581 | Comparative Example |
| 50 | 62 | 10 | 51 | 3.1 | 189 | 2322 | 47 | 581 | Comparative Example |
| 51 | 41 | 32 | 57 | 3.2 | 171 | 2424 | 41 | 609 | Comparative Example |
| 52 | 74 | 1 | 22 | 5.0 | 188 | 2000 | 37 | 531 | Comparative Example |
| 53 | 80 | 4 | 21 | 4.3 | 179 | 2510 | 51 | 441 | Comparative Example |
| 54 | 76 | 1 | 17 | 4.9 | 187 | 2057 | 36 | 539 | Comparative Example |
| 55 | 80 | 3 | 48 | 5.1 | 186 | 2409 | 69 | 481 | Comparative Example |
| 56 | 87 | 1 | 49 | 5.0 | 179 | 2102 | 69 | 450 | Comparative Example |
| 57* | 74 | 4 | 16 | 5.4 | 174 | 2286 | 41 | 600 | Comparative Example |

An underline represents that a condition is out of the range of the present invention, a manufacturing condition is not preferred, or characteristics are not preferred.

*heating and holding before holding at low temperature

INDUSTRIAL APPLICABILITY

According to the aspect of the present invention, it is possible to obtain a hot-stamping formed body that is excellent in strength and collision characteristics.

The invention claimed is:

1. A hot-stamping formed body comprising, as a chemical composition, by mass %:

C: 0.15% to 1.00%;
Si: 0.50% to 3.00%;
Mn: more than 3.00% and 5.00% or less;
Al: 0.100% to 3.000%;
Co: 0.100% to 3.000%;
P: 0.100% or less;
S: 0.1000% or less;
N: 0.0100% or less;
Nb: 0% to 0.15%;
Ti: 0% to 0.150%;
Mo: 0% to 1.00%;
Cr: 0% to 1.00%;
Cu: 0% to 1.00%;
V: 0% to 1.00%;
W: 0% to 1.00%;
Ni: 0% to 3.00%;
Mg: 0% to 1.00%;
Zr: 0% to 1.00%;
Sb: 0% to 1.00%;
Ca: 0% to 0.10%;
REM: 0% to 0.30%;
B: 0% to 0.0100%; and
a remainder comprising Fe and impurities; and a microstructure which includes residual austenite of which an area ratio is 10% or more and less than 20%, fresh martensite of which an area ratio is 5% to 15%, bainite and tempered martensite of which a total area ratio is 65% to 85%, and a remainder in microstructure of which an area ratio is less than 5% at a depth position corresponding to ¼ of a sheet thickness from a surface of the hot-stamping formed body which is a region between a depth corresponding to ⅛ of the sheet thickness from the surface and a depth corresponding to ⅜ of the sheet thickness from the surface, among grain boundaries of crystal grains of the bainite and the tempered martensite, a ratio of a length of a grain boundary having a rotation angle in a range of 55° to 75° to a total length of a grain boundary having a rotation angle in a range of 4° to 12°, a grain boundary having a rotation angle in a range of 49° to 54°, and the grain boundary having a rotation angle in a range of 55° to 75° to the <011> direction as a rotation axis is 30% or more.

2. The hot-stamping formed body according to claim 1, comprising, as the chemical composition, by mass %, at least one of:

Nb: 0.01% to 0.15%;
Ti: 0.010% to 0.150%;
Mo: 0.005% to 1.00%;
Cr: 0.005% to 1.00%;
Cu: 0.001% to 1.00%;
V: 0.0005% to 1.00%;
W: 0.001% to 1.00%;
Ni: 0.001% to 3.00%;
Mg: 0.001% to 1.00%;
Zr: 0.001% to 1.00%;
Sb: 0.001% to 1.00%;
Ca: 0.001% to 0.10%;
REM: 0.001% to 0.30%; and
B: 0.0005% to 0.0100%.

3. A hot-stamping formed body consisting of, as a chemical composition, by mass %:

C: 0.15% to 1.00%;
Si: 0.50% to 3.00%;
Mn: more than 3.00% and 5.00% or less;
Al: 0.100% to 3.000%;
Co: 0.100% to 3.000%;
P: 0.100% or less;
S: 0.1000% or less;
N: 0.0100% or less;
Nb: 0% to 0.15%;
Ti: 0% to 0.150%;
Mo: 0% to 1.00%;
Cr: 0% to 1.00%;
Cu: 0% to 1.00%;
V: 0% to 1.00%;
W: 0% to 1.00%;
Ni: 0% to 3.00%;
Mg: 0% to 1.00%;
Zr: 0% to 1.00%;
Sb: 0% to 1.00%;
Ca: 0% to 0.10%;
REM: 0% to 0.30%;
B: 0% to 0.0100%; and
a remainder consisting of Fe and impurities; and a microstructure which includes residual austenite of which an area ratio is 10% or more and less than 20%, fresh martensite of which an area ratio is 5% to 15%, bainite and tempered martensite of which a total area ratio is 65% to 85%, and a remainder in microstructure of which an area ratio is less than 5% at a depth position corresponding to ¼ of a sheet thickness from a surface of the hot-stamping formed body which is a region between a depth corresponding to ⅛ of the sheet thickness from the surface and a depth corresponding to ⅜ of the sheet thickness from the surface, among grain boundaries of crystal grains of the bainite and the tempered martensite, a ratio of a length of a grain boundary having a rotation angle in a range of 55° to 75° to a total length of a grain boundary having a rotation angle in a range of 4° to 12°, a grain boundary having a rotation angle in a range of 49° to 54°, and the grain boundary having a rotation angle in a range of 55° to 75° to the <011> direction as a rotation axis is 30% or more.

* * * * *